US008011859B2

(12) United States Patent
Freitag et al.

(10) Patent No.: US 8,011,859 B2
(45) Date of Patent: Sep. 6, 2011

(54) GROUND REINFORCED STRUCTURE AND REINFORCEMENT MEMBERS FOR THE CONSTRUCTION THEREOF

(75) Inventors: Nicolas Freitag, Orsay (FR); Jean-Claude Morizot, Paris (FR)

(73) Assignee: Terre Armee Internationale, Velizy, Villacoublay (FR)

( * ) Notice: Subject to any disclaimer, the term of this patent is extended or adjusted under 35 U.S.C. 154(b) by 0 days.

(21) Appl. No.: 12/530,194

(22) PCT Filed: Feb. 29, 2008

(86) PCT No.: PCT/FR2008/050347

§ 371 (c)(1),
(2), (4) Date: Sep. 4, 2009

(87) PCT Pub. No.: WO2008/122733

PCT Pub. Date: Oct. 16, 2008

(65) Prior Publication Data

US 2010/0092249 A1 Apr. 15, 2010

(30) Foreign Application Priority Data

Mar. 5, 2007 (FR) ..... 07 01579

(51) Int. Cl.
*E02D 29/02* (2006.01)

(52) U.S. Cl. ..... 405/262; 405/284; 405/302.4; 405/302.7

(58) Field of Classification Search ..... 405/262, 405/284, 285, 286, 302.4, 302.6, 302.7
See application file for complete search history.

(56) References Cited

U.S. PATENT DOCUMENTS

| | | | | |
|---|---|---|---|---|
| 4,273,476 | A * | 6/1981 | Kotulla et al. | 405/284 |
| 4,343,571 | A * | 8/1982 | Price | 405/284 |
| 5,807,030 | A | 9/1998 | Anderson et al. | |
| 5,839,855 | A * | 11/1998 | Anderson et al. | 405/262 |
| 6,468,004 | B1 * | 10/2002 | Price | 405/262 |
| 7,491,018 | B2 * | 2/2009 | Freitag et al. | 405/262 |
| 2001/0014255 | A1 * | 8/2001 | Orsat | 405/15 |
| 2006/0110221 | A1 * | 5/2006 | Freitag et al. | 405/262 |
| 2006/0171783 | A1 * | 8/2006 | Freitag et al. | 405/262 |
| 2006/0239783 | A1 | 10/2006 | Kallen | |

FOREIGN PATENT DOCUMENTS

| | | |
|---|---|---|
| EP | 1 662 050 | 5/2006 |
| WO | WO 99/35343 | 7/1999 |

* cited by examiner

*Primary Examiner* — Frederick L Lagman
(74) *Attorney, Agent, or Firm* — McKenna Long & Aldridge LLP

(57) ABSTRACT

A soil reinforced structure and method of manufacturing the structure is disclosed, the structure includes fill, reinforcement strips including reinforcement sections extending in a reinforced area of the fill at the rear of a front face of the structure, and a facing along the front face, the reinforcement strips are anchored to the facing in anchoring regions, and at least one anchoring region includes a path formed for a reinforcement strip between two protruding points located on a rear face of the facing adjacent to the fill, and at least two reinforcement sections each prolong a rectilinear portion of a path beyond a protruding point and are connected together by at least one linking member and each of the reinforcement sections is a part of a reinforcement strip arranged according to the path, and the linking members are flexible strips fastened to the reinforcement strips above or underneath the reinforcement strips.

18 Claims, 8 Drawing Sheets

FIG.1.
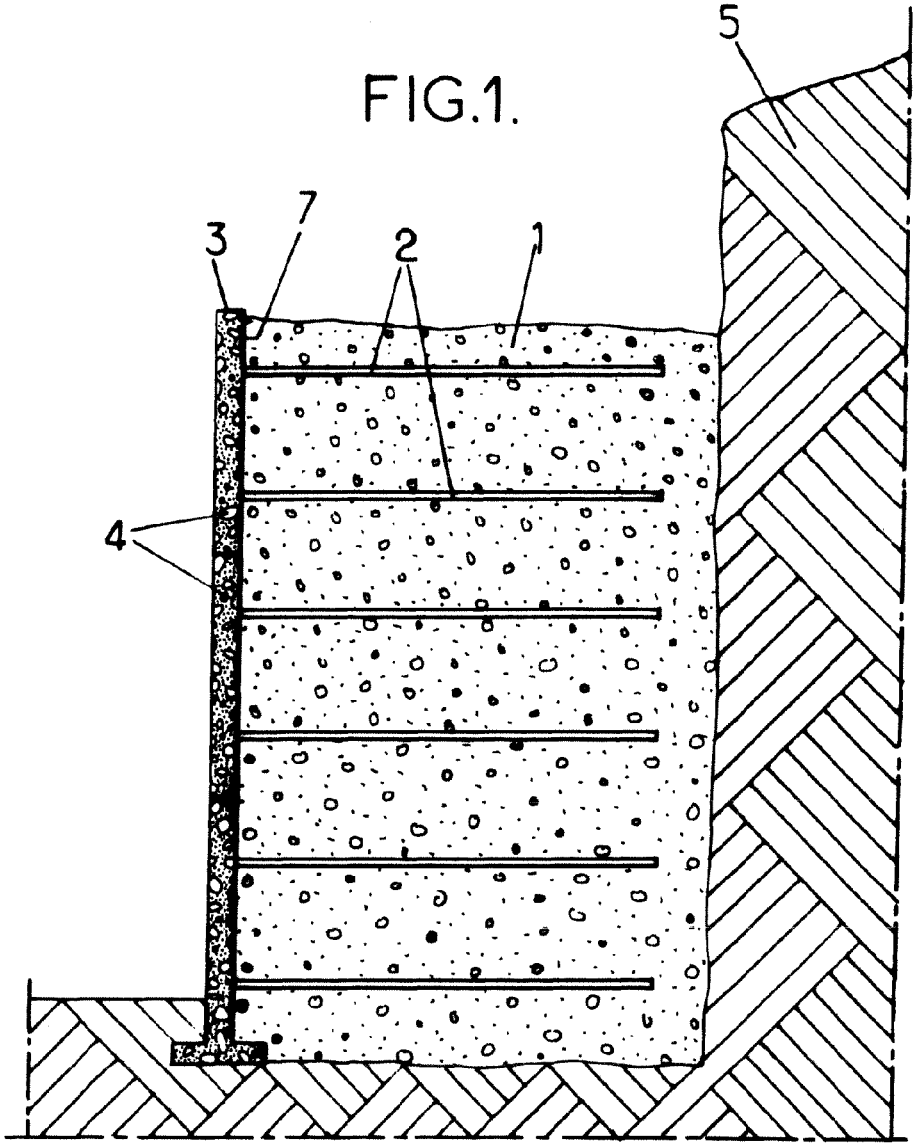
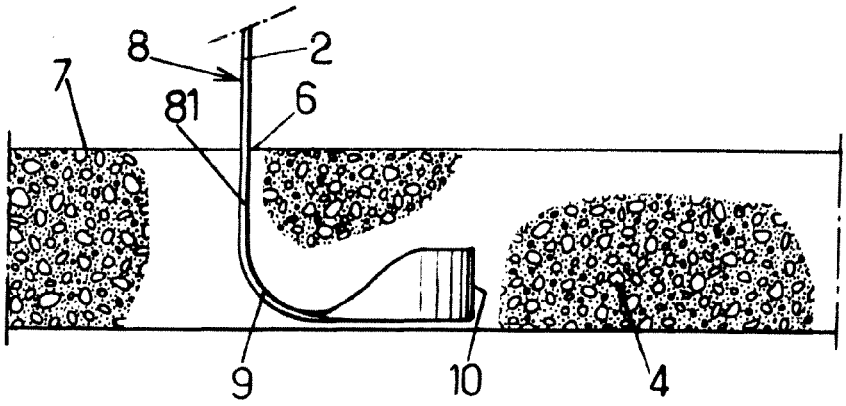
FIG.2.

GROUND REINFORCED STRUCTURE AND REINFORCEMENT MEMBERS FOR THE CONSTRUCTION THEREOF

This application is a National Stage Entry of International Application No. PCT/FR2008/050347, filed Feb. 29, 2008, and claims priority to French Patent Application No. 0701579, filed in France on Mar. 5, 2007, each of which is hereby incorporated by reference in its entirety as if fully set forth herein.

This invention relates to the construction of reinforced earth or soil reinforced structures. This construction technique is commonly used to realize structures such as retaining walls, bridge abutments, etc.

A soil reinforced structure combines a compacted fill, a facing and reinforcements normally connected to the facing. The reinforcements are set in place in the soil with a density that depends on the constraints that can be exerted on the structure, the soil pressure efforts being taken up by the soil-reinforcement friction.

The invention is particularly interesting in the case where the reinforcements are in the form of a strip made of synthetic material, for example of a polyester fiber base.

The facing is most often realized using prefabricated concrete members, in the form of slabs or blocks, juxtaposed in order to cover the front face of the structure. There can be transverse thrusts on this front face between different levels of facing, when the structure comprises one or several terraces.

The reinforcements placed in the fill are usually attached to the facing using mechanical connecting members that can have various forms. Once the structure is completed, the reinforcements distributed in the fill transmit high loads, which can attain several tons. Their connection to the facing must be robust in order to retain overall cohesion.

The connecting members have risks of degradation. They are often sensitive to corrosion due to humidity or to chemical agents present or infiltrated into the fill. The connecting members are sometimes of a base of resins or of composite materials in order to be less easily corrodible. But their cost is then increased, and it is difficult to provide them with good mechanical properties. It is as such desirable to be able to avoid the use of connecting members between the facing member and the reinforcements of the structure.

In certain systems, the facing members are conformed in such a way as to have at least one passage intended to receive a reinforcement strip.

In FR 2878268, a soil reinforced structure is proposed, comprising a fill, reinforcement strips extending in a reinforced area of the fill located at the rear of a front face of the structure, and a facing placed along said front face, the reinforcement strips being anchored to the facing in the respective anchoring regions. In at least one anchoring region, the facing incorporates a path formed for a reinforcement strip between two protruding points located on a rear face of the facing adjacent to the fill. This path comprises two rectilinear portions respectively adjacent to the two protruding points and each one arranged in order to position the strip in the same protruding plane perpendicular to said rear face, two curved portions respectively defining an extension of the two rectilinear portions and arranged to divert the strip outside from the protruding plane, and a connecting portion connecting together the two curved portions and having at least one loop located outside of the protruding plane.

This arrangement allows for a good positioning and effective anchoring of the reinforcement strip while preventing it from having to follow curvatures that are too sharp or from having to apply substantial baulk efforts (tightening) to it.

In general, the distribution of the reinforcement strips is calculated according to the soil pressure efforts and the number of reinforcement strips required for a given configuration is determined according to the soil-reinforcement friction.

In light of responding to the constant concern of increasing the resistance of the structures and/or reducing costs—by decreasing the number of reinforcement strips required for the same configuration—it is advantageous to be able to increase the soil-reinforcement friction coefficient.

The purpose of this invention is to propose a configuration of reinforcement strips that makes possible an advantageous anchoring to a facing of a soil reinforced structure and to respond to the aforementioned concerns.

The invention as such proposes a soil reinforced structure, comprising a fill, reinforcement strips comprising reinforcement sections which extend in a reinforced area of the fill located at the rear of a front face of the structure, and a facing placed along said front face, the reinforcement strips being anchored to the facing in the respective anchoring regions, wherein the facing incorporates, in at least one anchoring region, a path formed for a reinforcement strip between two protruding points located on a rear face of the facing adjacent to the fill, and where the path comprises two rectilinear portions respectively adjacent to the two protruding points and each arranged to position the strip in the same protruding plane (P) perpendicular to said rear face, two curved portions respectively defining an extension of the two rectilinear portions and arranged to divert the strip outside from the protruding plane (P), and a connecting portion connecting together the two curved portions and having at least one loop located outside of the protruding plane, where at least two reinforcement sections each prolong a rectilinear portion of a path beyond a protruding point and are connected together by at least one linking member and where each one of said reinforcement sections is part of a reinforcement strip arranged according to said path.

Connecting together at least two reinforcement sections that are part of a reinforcement strip arranged according to said path by at least one linking member makes it possible to significantly increase the soil-reinforcement friction coefficient.

The number of reinforcement strips required to reinforce a structure can advantageously be reduced, with a given configuration or increase the margin of safety for the same distribution of reinforcement strips.

According to an embodiment, the linking members are strips. These linking strips can be fastened to the reinforcement strips by stapling, gluing or any other appropriate technique. This fastening can be carried out before or after positioning reinforcement strips according to said path.

According to an embodiment, the linking members are arranged according to an angle $\alpha$, between 30° and 150° more preferably between 60° and 120°, even substantially equal to 90°, where the angle $\alpha$ measures the angular separation in the plane P between the axis of one of the reinforcement sections and the axis of the linking member. According to the invention, the reinforcement sections can be arranged so that the latter are substantially parallel together.

According to different embodiments, which can be combined:

- the facing is realized using members in the form of panels, and wherein the rectilinear portions of said path extend each in the protruding plane (P) over at least half of the thickness of a facing member in the form of panels;
- the reinforcement strip has a length at most equal to half of the thickness of the facing;

the facing has, in the anchoring region, a protective shaft receiving the reinforcement strip along said path.

According to an embodiment, two reinforcement sections connected together by at least one linking member are part of the same reinforcement strip arranged according to said path. In this configuration, the reinforcement sections of the same strip are connected together by a portion of this strip which follows said path and by at least one linking member as well.

It can be considered that several reinforcement sections of several strips also be connected together by the same reinforcement member.

According to the preceding embodiment, the structure can include a plurality of reinforcement strips that are independent of one another and arranged according to said path where each reinforcement strip comprises two reinforcement sections connected together by a plurality of linking members.

According to another embodiment, at least two reinforcement sections connected together by at least one linking member are part of two separate reinforcement strips, each one being arranged according to said path. In this configuration reinforcement sections of several separate linking strips are connected together by the same reinforcement member.

According to the preceding embodiment, said separate reinforcement strips each include first and second reinforcement sections wherein the first and/or second reinforcement sections are connected together by linking members.

The invention also relates to a reinforcement member intended to reinforce a structure comprising a fill, comprising at least two reinforcement strips with reinforcement sections substantially parallel together, where the reinforcement sections of two different reinforcement strips are connected together by at least one linking member and the reinforcement strips are twisted a half-turn between two linking members. Such a reinforcement member is able to be arranged in the facing in order to realize a structure where the reinforcement sections of several separate linking strips are connected together by the same reinforcement member.

According to the invention, said reinforcement member can have the following characteristics, alone or in combination:

- the linking members are arranged substantially symmetrically in relation to an axis passing through the middle of the reinforcement strips connected together;
- the reinforcement strips are twisted a half-turn in a first direction and a half-turn in an opposite direction between two linking members;
- the linking members are strips.

The invention also relates to a method of manufacturing of a reinforcement member intended to reinforce a structure comprising a fill comprising the following successive steps:

- arranging at least two reinforcement strips in a substantially parallel manner,
- connecting the reinforcement strips by a plurality of linking members,
- folding back the reinforcement strips on themselves in such a way as to form a loop between two linking members.

The aforementioned reinforcement member can thus be realized. According to an embodiment of said method, the reinforcement strips are twisted a half-turn before arranging at least one linking member on each side of the twisted portion.

The invention also relates to a method of manufacturing a soil reinforced structure comprising a fill, reinforcement strips comprising reinforcement sections which extend in a reinforced area of the fill located at the rear of a front face of the structure, and a facing placed along said front face, the reinforcement strips being anchored to the facing in respective anchoring regions comprising the following steps:

- implementing the method and/or supply of reinforcement members,
- incorporating into the facing reinforcement members in such a way as to form at least one path between two protruding points located on a rear face of the facing adjacent to the fill wherein a path comprises two rectilinear portions respectively adjacent to the two protruding points and each one arranged in the same protruding plane (P) perpendicular to said rear face, two curved portions respectively define an extension of the two rectilinear portions and arranged outside from the protruding plane (P), and a connecting portion connecting together the two curved portions and having at least one loop located outside of the protruding plane.

The strip can be put into place according to the path as soon as the casting of the prefabricated members with or without protective shaft. The use of such a shaft insulates the strip from the casted material in order to protect the reinforcement from premature damage. In particular, if the reinforcement is procured by polyester fibers, it is known that the latter poorly admit basic environments such as those found in concrete. The aforementioned shaft thus supplements the protection conferred by the plastic sheath which coats the polyester fibers of the strip.

If a protective shaft is used, the reinforcement strips are introduced after the casting and the link of the reinforcement sections with a linking member is carried out after the introduction of the reinforcement strips into the prefabricated members. In the case where the use of a protective shaft is not desired, the introduction of the reinforcement strips can be carried out either after or before the casting. It is generally advantageous to carry it out before the casting and it is possible to cast the prefabricated members with the reinforcement strips which can be connected by a linking member either before, or after the casting. The incorporation at the time of casting of reinforcement strips connected together beforehand by linking members can be advantageous as it makes it possible to separate the steps of implementing the method and to prepare the reinforcement strips connected together independently of the step of casting. This can result in significant gains in productivity.

Several arrangements are possible for the path defined for the strip within the facing member. In certain embodiments, the two curved portions of the path direct the strip towards the same side of the protruding plane. In this case, a first possibility is that the path is formed in such a way that the strip is received in the two rectilinear portions with the same face of the strip directed towards this side of the protruding plane. The path is then formed in such a way that said face of the strip is placed either on the exterior side or on the interior side of the loop located outside of the protruding plane. A second possibility is that the path is formed in such a way that the strip is received in one of the two rectilinear portions with a face of the strip directed towards said side of the protruding plane and in the other of the two rectilinear portions with said face of the strip directed opposite of said side of the protruding plane.

In another embodiment, the two curved portions of the path direct respectively the strip towards two sides opposite the protruding plane, and the connecting portion of the path has two loops respectively prolonging the two curved portions of the path and a portion crossing the protruding plane and connecting together the two loops.

Other particularities and advantages of this invention shall appear in the description hereinafter of examples of embodiments that are not limiting, in reference to the annexed drawings, wherein:

FIG. 1 is a schematic view as a lateral cross-section of a soil reinforced structure according to the invention in the process of construction;

FIG. 2 is a cross-section view of a facing member comprising a reinforcement member according to the invention;

Figure 3:
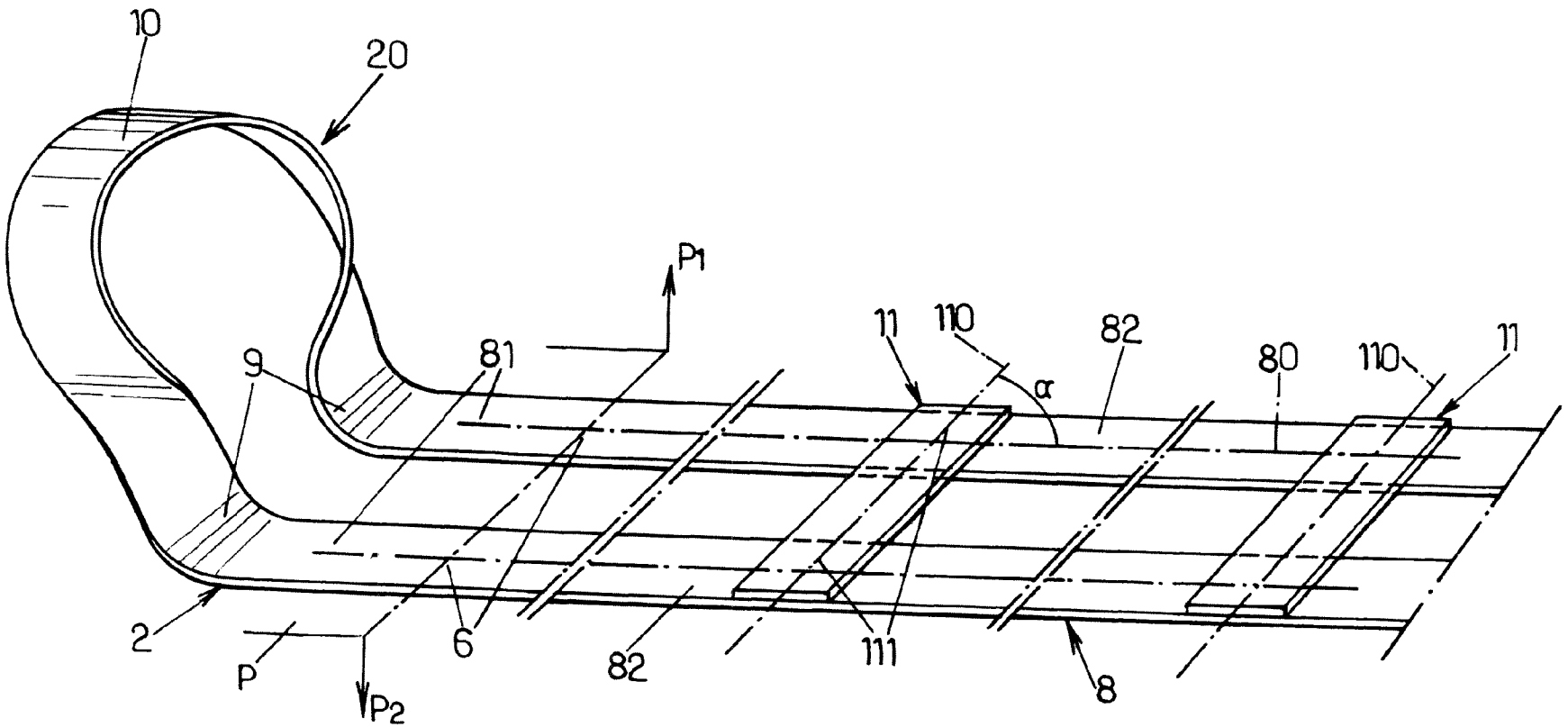
FIG. 3 shows a perspective view of a path that a reinforcement strip can follow within a facing member for a configuration according to the invention wherein a plurality of linking members connect together reinforcement sections of the same reinforcement strip.

For reasons of clarity, the dimensions of the different members shown in these figures are not in proportion with their actual dimensions. In all of the figures, identical references correspond to identical members.

According to the invention, "reinforcement strip" 2 means a continuous strip. Such a strip can include one or several reinforcement sections 82, 83, 84 extending in a reinforced area of the fill 1. Generally, but in a non-limited way, a reinforcement strip comprises two reinforcement sections.

FIG. 1 shows the application of the invention to the construction of a soil reinforced retaining wall. A compacted fill 1, wherein are distributed reinforcements 2, is delimited on the front side of the structure by a facing 3 constituted by juxtaposing prefabricated members 4 in the form of panels, and on the rear side by the terrain 5 against which is erected the retaining wall.

The reinforcements 2 consist of synthetic reinforcements in the form of flexible strips extending in horizontal planes at the rear of the facing 3. It can in particular entail polyester fiber-base reinforcement strips sheathed with polyethylene.

The reinforcement strips 2 are attached to the prefabricated members 4 assembled to form the facing 3. These members 4 are typically made of reinforced concrete. In the example shown, they are in the form of panels. They could also have other forms, in particular a block. When the concrete of such a member 4 is cast, one or several reinforcement strips 2 are installed in the cast according to a path described further on in order to realize the strip-member anchoring. After the concrete has set, each strip has two sections which exit the member in order to be installed in the packed pad.

In order to edify the structure, it is possible to proceed as follows:

a) set in place a portion of the facing members 4 in order to be able to then add fill material over a certain height. In a known manner, the assembling and the positioning of the facing members can be facilitated by assembling members placed between them. The strips 2 are positioned on the facing members 4 in such a way that some of them are placed at the same horizontal level during the assembling of the facing;

b) add fill material and compact it progressively until the next level is reached provided for the setting in place of the reinforcement strips 2;

c) spread the reinforcement strips 2 on the fill to this level;

d) add fill material on top of the reinforcement strips 2 which have just been installed. This fill material is compacted as it is added;

e) repeat steps b) to d) if several levels of strips are provided per row of facing members 4;

f) repeat steps a) to e) until the upper level of the fill is reached.

During the adding and the compacting of the fill material, the reinforcement strips 2 already set into place in the lower levels become taught. This becoming taught is the result of the friction between the strips and the packed material and assures the reinforcing of the structure. So that the tension can establish itself in good conditions, it is suitable for the strips of a level exit their facing members as all being well aligned on this level. It is further suitable that they be directed horizontally as soon as they exit from the facing, in order to avoid them from twisting in the packed pad.

On their protruding points 6 outside from a facing member, the two sections of a strip 2 are in the same protruding plane P (perpendicular to the plane in FIG. 2). During the assembling of the facing 3, the members 4 are directed in such a way that this protruding plane is horizontal.

FIG. 2 shows a facing member that can be used in certain embodiments of the invention. As is usual, this member 4 is made of cast concrete. A reinforcement strip 2 is placed in the cast at the time of pouring the concrete and is maintained until the concrete sets. Its guiding can be realized using reinforcing bars of the concrete (not shown), and may be supplemented by rods or members for deviating fastening to these bars, so that the strip follows the desired path in the zone of anchoring. This path is defined inside the member 4 between the two protruding points 6 of the two sections of the strip on the rear face 7 of the member (face adjacent to the fill).

A path 20 corresponding to a case wherein a plurality of linking strips connect together reinforcement sections of the same reinforcement strip, is shown in FIG. 3. It has two rectilinear portions 81 extending perpendicularly to the rear face 7 of the member starting from the protruding points 6. In each rectilinear portion 81, the strip remains in its protruding plane P. The rectilinear portions 81 extend over at least half of the thickness of the body of the member 4, measured perpendicularly to its rear face 7. This avoids poor solicitation of the concrete in the vicinity of the rear face 7.

Each rectilinear portion 81 of the path of the strip is prolonged by a respective curved portion 9 wherein the strip is diverted outside from the protruding plane P. Beyond this curved portion 9, the strip 2 extends along the forward face of the member, slightly withdrawn in relation to forward this in order to not be apparent on the surface of the structure.

The two curved portions 9 are connected together by a connecting portion which has a loop 10 located outside of the protruding plane P.

In this example, the strip is directed towards the same side P1 of the protruding plane P in the two curved portions 9 of its path within the facing member 4. This path is formed in such a way (i) that in the two rectilinear portions 8, the strip has the same face directed towards the side P1 of the protruding plane, and (ii) that this face of the strip is placed on the exterior side of the loop 10. Consequently, in the middle of the loop 10, the strip is placed practically perpendicularly to the rear face 7 of the member.

Two reinforcement sections 82 each prolong a rectilinear portion 81 of said path, beyond a protruding point 6. A rectilinear portion 81 extended by a reinforcement section 82 constitutes a rectilinear portion 8 of a reinforcement strip 2. In the case shown, two rectilinear portions 8 of the same reinforcement strip are arranged substantially in parallel. The two reinforcement sections 82 are connected together by a plurality of linking members 11, constituted in the example shown of strips of likewise nature as the reinforcement strip 2. These linking strips 11 can be stapled, glued or connected by any other means to the reinforcement sections 82 in a zone 111.

In the example shown, the linking members 11 are arranged according to an angle α substantially equal to 90°, where the angle α measures the angular separation in the plane P between the axis 80 of a reinforcement section 82 and the axis 110 of a linking member 11.

FIGS. 4 to 8 show different embodiments wherein reinforcement strips 2 follow a path 20 and wherein a plurality of linking members 12, 13 connect together reinforcement sections 84, 83 of several separate reinforcement strips 2. In all of these figures, the reinforcement strips 2 include a first 84 and a second 83 reinforcement sections. The first reinforcement sections 84 of several reinforcement strips 2 are connected together by a plurality of linking members 12 and the second reinforcement sections 83 of the same reinforcement strips 2 are connected together by a plurality of linking members 13.

The linking members 12 and 13 are arranged according to an angle α substantially equal to 90°, where the angle α measures the angular separation in the plane P between the axis 80 of a reinforcement section, for example 84 and the axis, for example 120 of a linking member 12.

In the embodiments shown, the linking members 13 that connect together the second reinforcement sections 83 are arranged below the first reinforcement sections 84. These linking members 13 are connected, in particular via stapling or gluing, by the top to the second reinforcement sections 83 in the zones 131 and pass under the first reinforcement sections 84 in zones 132.

The linking members 12 that connect together the first reinforcement sections 84 are connected, in particular via stapling or gluing, to the lower face of the first reinforcement sections 84 in zones 121. These linking members 12 are arranged above the second reinforcement sections 83 in zones 122.

Figure 4:
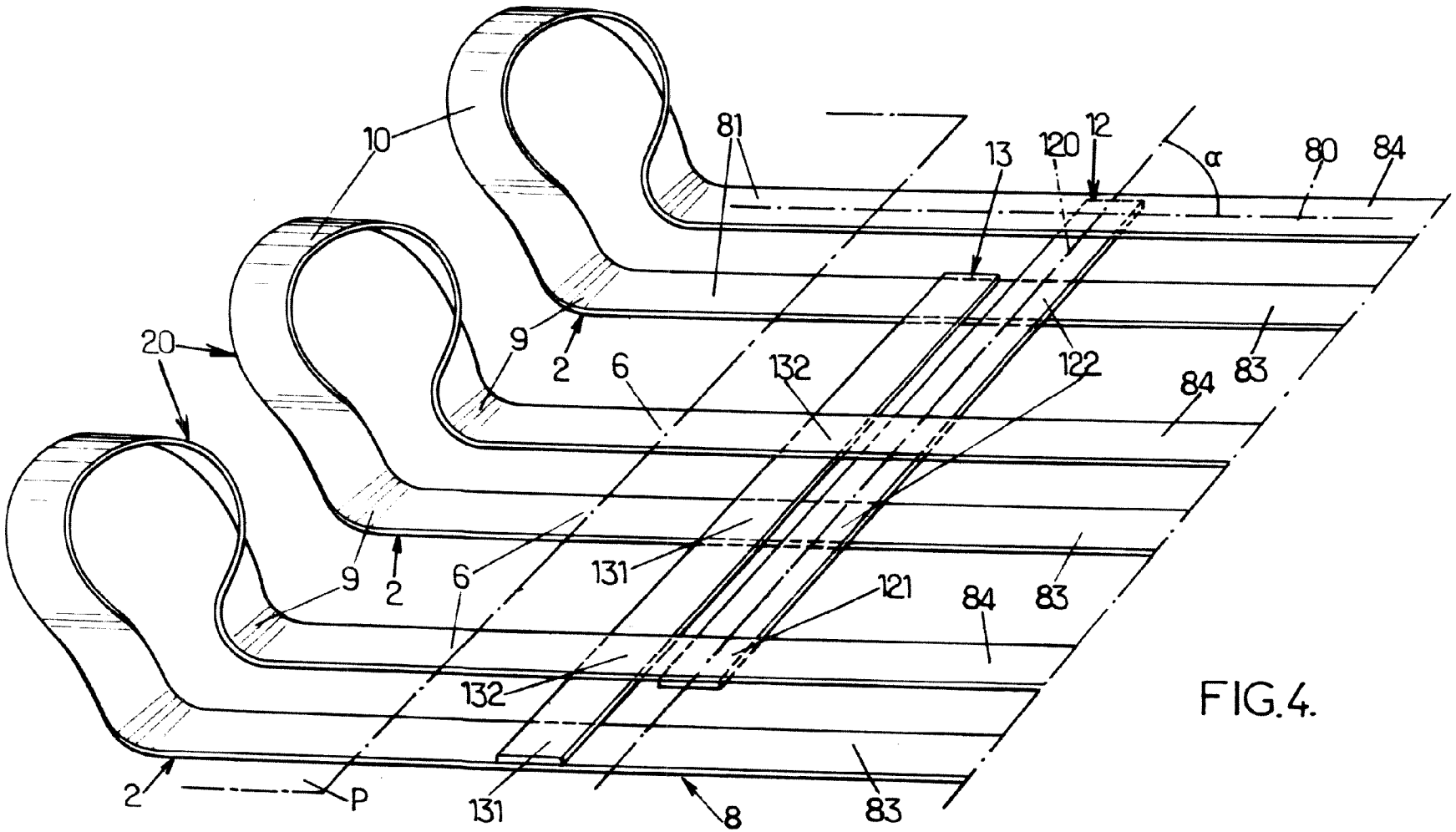
FIGS. 4 to 8 show perspective views of several paths that reinforcement strips can follow within the facing members for configurations according to the invention wherein a plurality of linking members connect together reinforcement sections of several separate reinforcement strips.

FIG. 4 shows an embodiment wherein the path 20 is similar to that shown in FIG. 3 of which the description can be referred to and wherein a loop 10 is part of the path 20.

Figure 5:
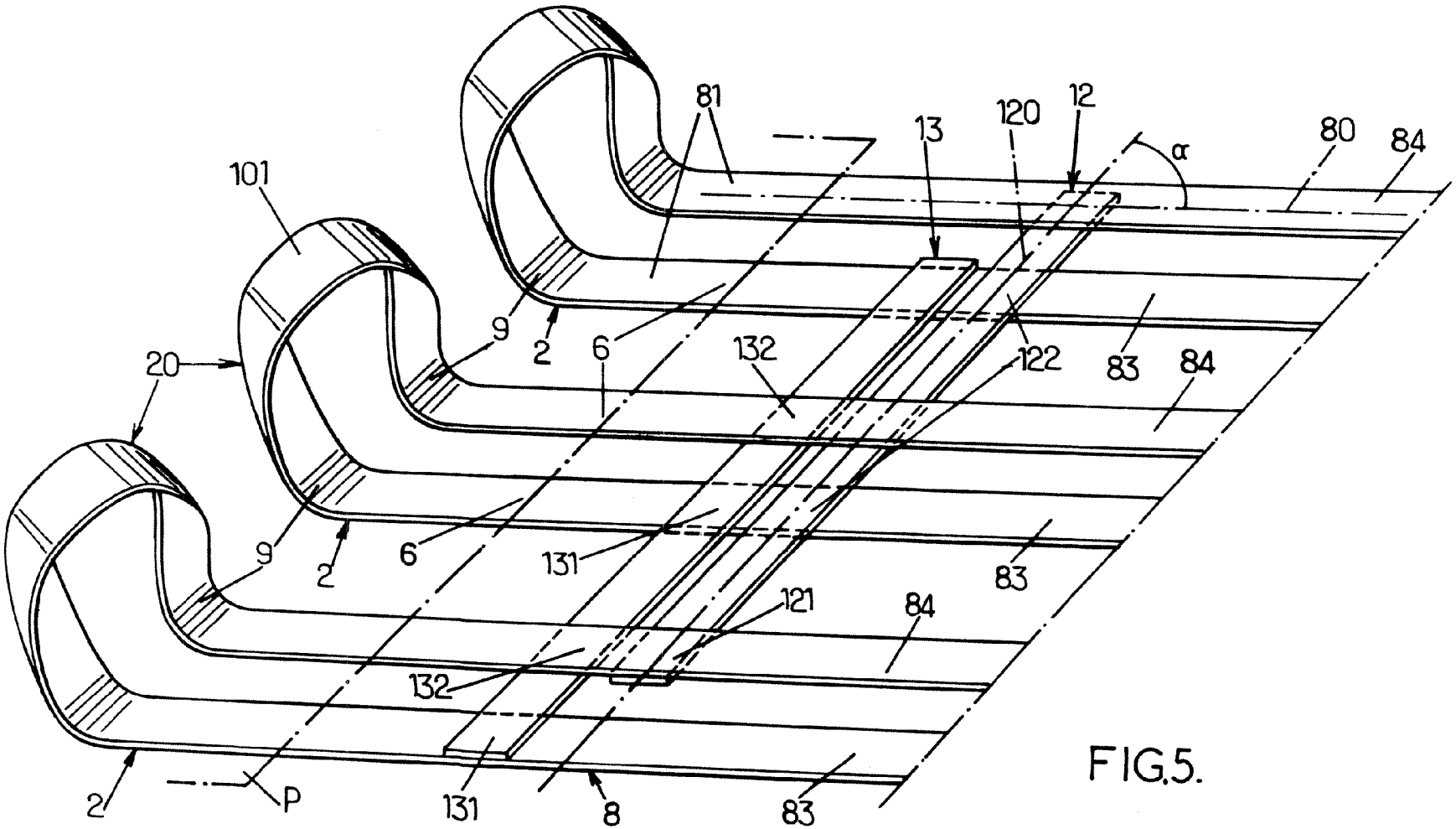

In the alternative shown in FIG. 5, the loop 101 of the path 20 is directed in the opposite direction, i.e. the face of the strip directed towards the side P1 of the protruding plane is placed on the interior side of the loop 101.

Figure 6:
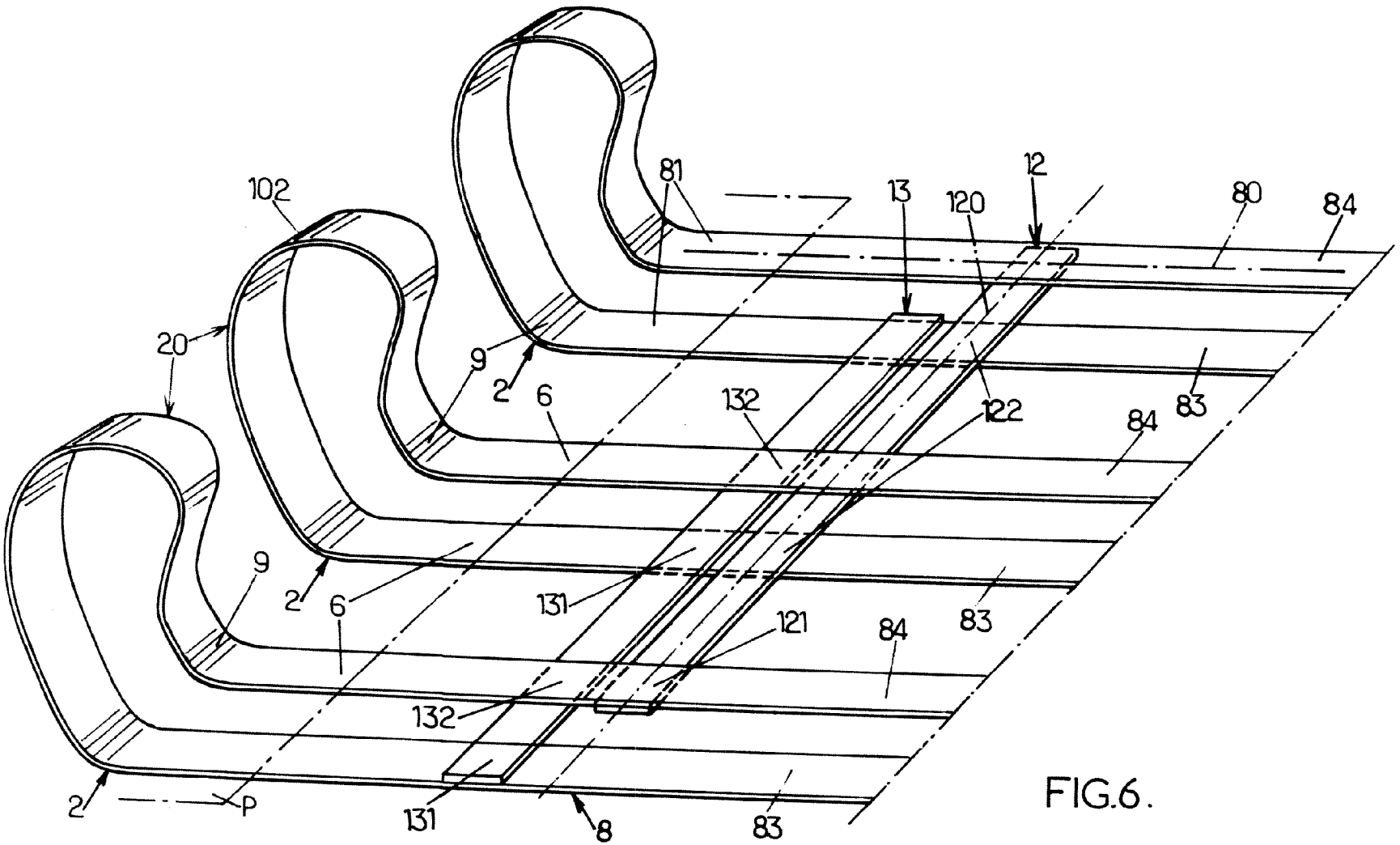

In the alternative shown in FIG. 6, the strip follows one of the two rectilinear portions 81 of its path 20 with one of its two faces directed towards the side P1 of the protruding plane P and the other of the two rectilinear portions 81 with said face directed towards the side P2 of the protruding plane opposite the side P1 and as such forms a loop 102.

Figure 7:
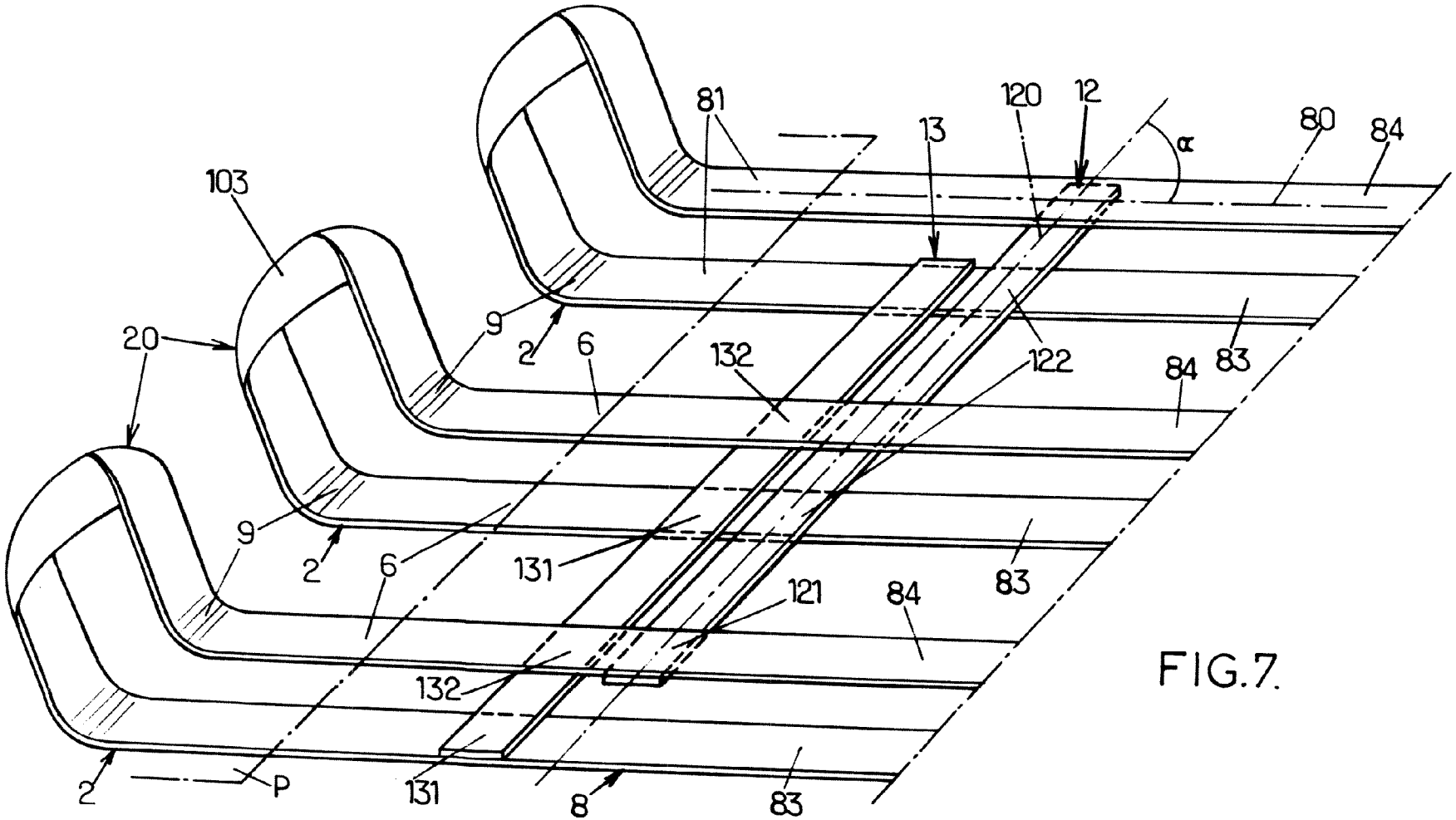

In the alternative shown in FIG. 7, the strip is twisted twice a half-turn, in a first and a second direction to form the loop 103 of the path 20. The upper face of the strip of the side of the first reinforcement section 84 is then the same as that of the side of the second reinforcement section 83 of the same strip 2.

Figure 8:
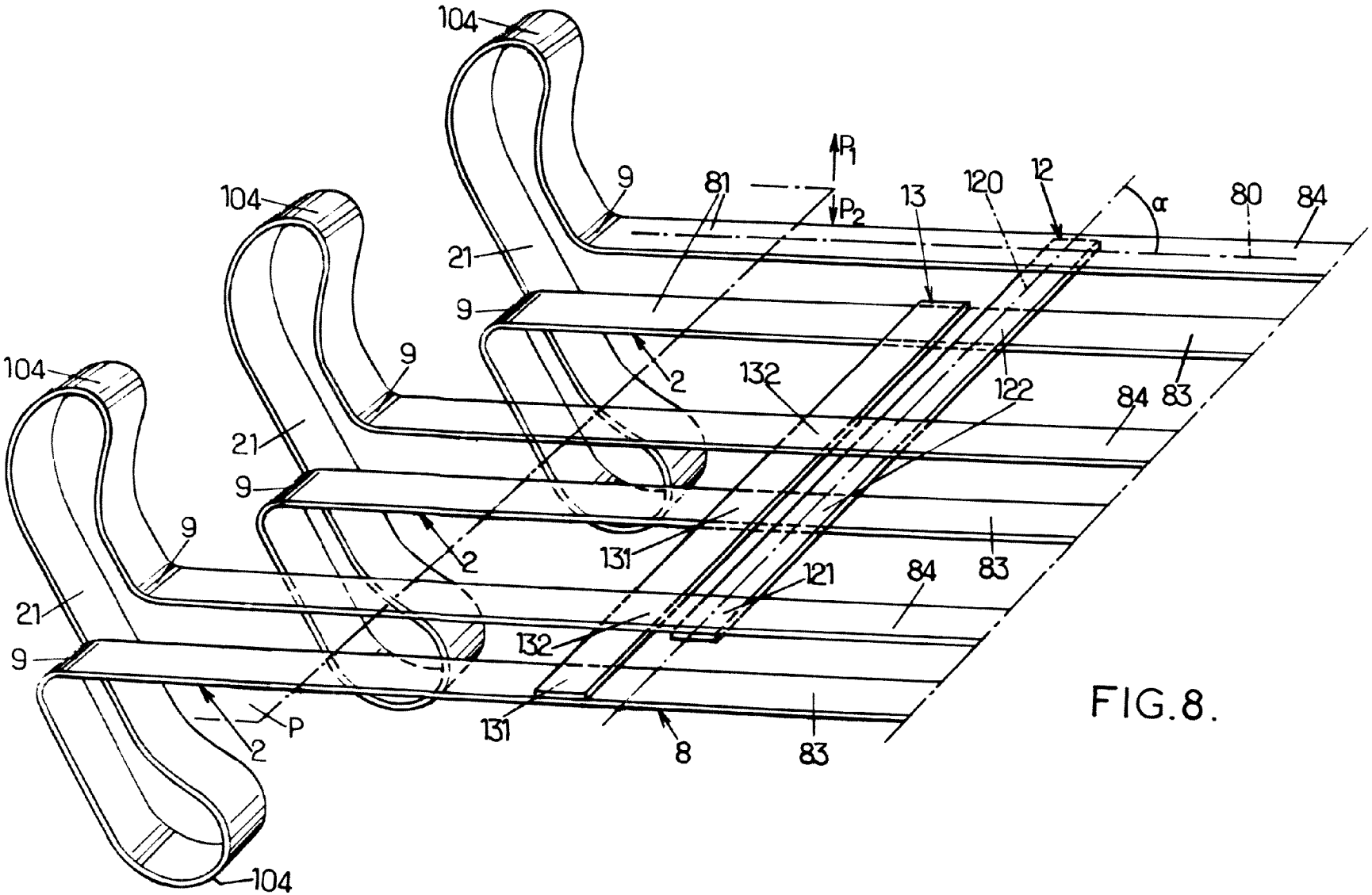

Other arrangements are still possible for the path of the reinforcement strip inside a facing member. FIG. 8 shows an example of this wherein the connecting portion connecting together the two curved portions 9 comprises two loops 104 on either side of the plane P. In this example, the two curved portions 9 of the path direct respectively the strip towards the two opposite sides P1, P2 of the protruding plane P. The connecting portion has a portion 21 which crosses the plane P and connects together the two loops 104.

Note that the loops 101, 102, 103, 104 shown respectively in FIGS. 5 to 8 can take the place of the loop 10 shown in FIG. 3 in order to realize embodiments of the invention that are alternatives to the one shown.

In order to easily follow a path such as those shown in FIGS. 3 to 8, it is preferable that the length of the reinforcement strip 2 be less than or at most equal to half of the thickness of the facing member 4. This thickness is typically between 14 and 16 cm. Strips of a length of approximately 45 mm can then be used.

Figure 9:
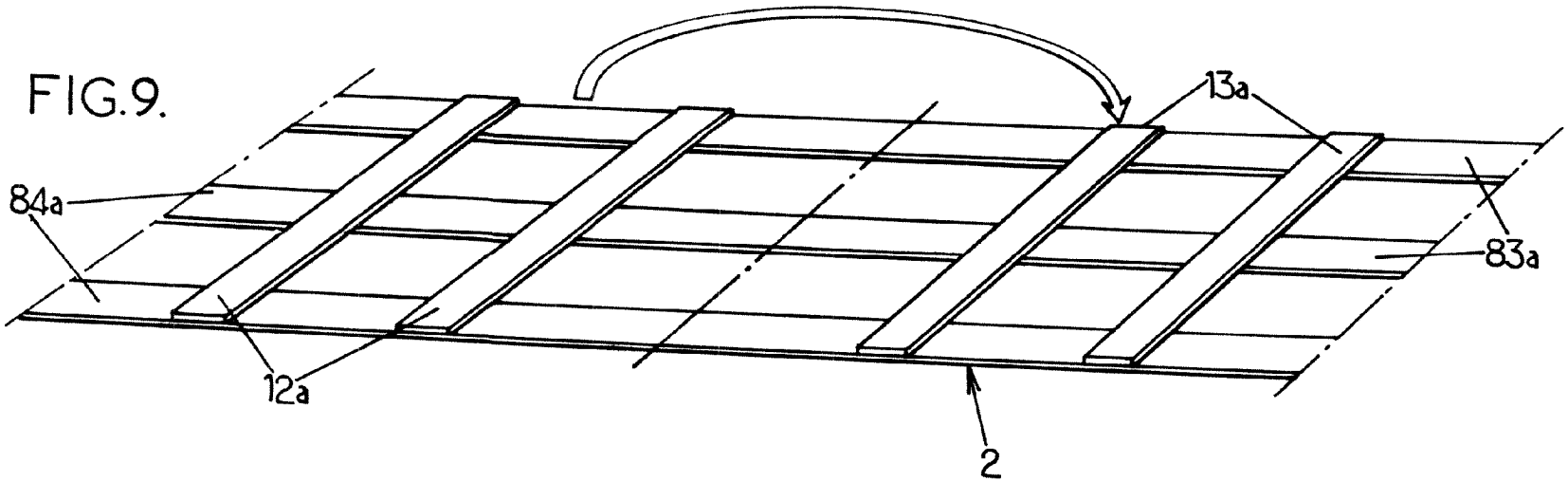
FIGS. 9 and 10 show reinforcement members used within the framework of the invention.
Figure 10:
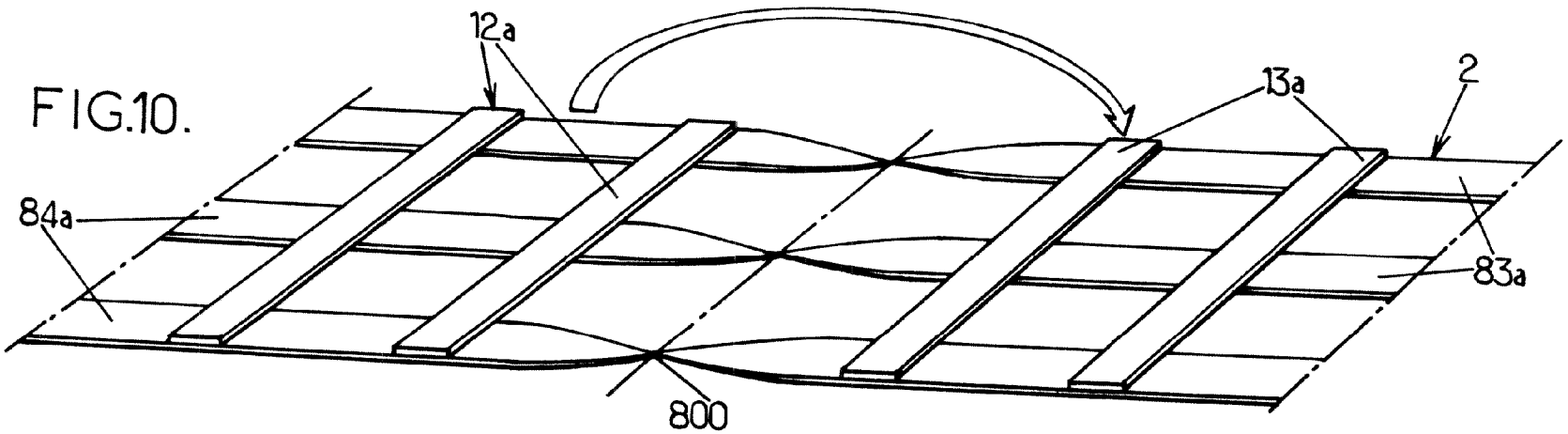

FIGS. 9 and 10 show reinforcement members used in the framework of the invention, where three reinforcement strips 2 are arranged in parallel. Each one of these strips comprises reinforcement sections 83*a*, 84*a* arranged on each side of an axis passing through the middle of the strips 2. These reinforcement members 83*a*, 84*a* are connected together by a plurality of linking members, respectively 13*a*, 12*a*, shown here in the form of a portion of strips of the same nature as the strips 2.

FIG. 9 shows a case wherein the faces of the strips 3 have all along their length a constant orientation. Such a reinforcement member can for example be manufactured by laying the strips flat and by stapling the linking members 12*a*, 13*a* to the reinforcement sections, respectively 84*a*, 83*a*. Such a reinforcement member is particularly advantageous because, according to the direction of the arrow shown, the portion comprising the reinforcement sections 84*a* and the linking members 12*a* can be folded back above the portion comprising the reinforcement sections 83*a* and the linking members 13*a*. A loop is then obtained in the central area of the reinforcement member, between each pair of reinforcement sections 83*a*, 84*a*.

The reinforcement member can then be arranged in a cast and a prefabricated member can be realized after casting, in particular with concrete. After arrangement in a fill to be reinforced, the configuration shown in FIG. 6 is obtained, wherein loops 102 are formed. The reinforcement sections 83*a* and 84*a* of the reinforcement member as such become the reinforcement sections 83 and 84 shown in FIG. 6, the linking members of the reinforcement member 12*a*, 13*a* as such become the linking members 12, 13.

FIG. 10 shows a case wherein the faces of the reinforcement strips have a change in orientation. Such a reinforcement member can for example be manufactured by laying the reinforcement strips 2 flat and by twisting them a half-turn in the region 800, located for example substantially in the middle of the reinforcement strips 2.

By folding back, according to the direction of the arrow shown, the portion comprising the reinforcement sections 84*a* and the linking members 12*a* above the portion comprising the reinforcement sections 83*a* and the linking members 13*a*, a loop is obtained in the central area of the reinforcement member, between each pair of reinforcement sections 83*a*, 84*a*.

The loops which are formed as such are of the type of loops 103 shown in FIG. 7. Likewise as hereinabove, the reinforcement member shown in FIG. 10 can be implemented in order to obtain the configuration shown in FIG. 7.

Generally, the method of reinforcing proposed, using a facing of a soil reinforced structure and reinforcement strips, is compatible with a large number of configurations of structure, strip lengths, densities for setting up strips, etc.

The invention claimed is:

1. A soil reinforced structure, comprising:

a fill, reinforcement strips comprising reinforcement sections that extend in a reinforced area of the fill located at the rear of a front face of the structure, and a facing placed along said front face, the reinforcement strips being anchored to the facing in respective anchoring regions, wherein the facing incorporates, in at least one anchoring region, a path formed for a reinforcement strip between two protruding points located on a rear face of the facing adjacent to the fill, and where the path comprises:

two rectilinear portions respectively adjacent to the two protruding points and each one arranged in order to position the strip in the same protruding plane (P) perpendicular to said rear face, two curved portions respectively defining an extension of the two rectilinear portions and arranged to divert the strip outside from the protruding plane (P), and a connecting portion connecting together the two curved portions and having at least one loop located outside of the protruding plane, wherein at least two reinforcement sections each prolong a rectilinear portion of a path beyond a protruding point and are connected together by at least one linking member and wherein each one of said reinforcement sections is a part of a reinforcement strip arranged according to said path, and wherein the linking members are flexible strips fastened to the reinforcement strips above or underneath said reinforcement strips.

2. The structure according to claim 1, wherein the linking members are arranged according to an angle $\alpha$, between 30° and 150° more preferably between 60° and 120°, even substantially equal to 90°, where the angle $\alpha$ measures the angular separation in the plane P between the axis of one of the reinforcement sections and the axis of the linking member.

3. The structure according to claim 1, wherein the reinforcement sections are substantially parallel together.

4. The structure according to claim 1, wherein the facing is realized using members in the form of panels, and wherein the rectilinear portions of said path each extend into the protruding plane (P) on at least half of the thickness of a facing member in the form of panels.

5. The structure according to claim 1, wherein the reinforcement strip has a length at most equal to half of the thickness of the facing.

6. The structure according to claim 1, wherein the facing has, in the anchoring region, a protective shaft receiving the reinforcement strip along said path.

7. The structure according to claim 1, wherein two reinforcement sections connected together by at least one linking member are part of the same reinforcement strip arranged according to said path.

8. The structure according to claim 7, comprising a plurality of reinforcement strips that are independent between themselves and arranged according to said path where each reinforcement strip comprises two reinforcement sections connected together by a plurality of linking members.

9. The structure according to claim 1, wherein at least two reinforcement sections connected together by at least one linking member are part of two separate reinforcement strips, each one being arranged according to said path.

10. The structure according to claim 9, wherein said separate reinforcement strips each include first and second reinforcement sections and the first and/or the second reinforcement sections are connected together by linking members.

11. The structure according to claim 1, wherein the flexible strips are fastened to the reinforcement strips by stapling or gluing.

12. A reinforcement member, intended to reinforce a structure comprising a fill, comprising at least two reinforcement strips with reinforcement sections substantially parallel together, wherein the reinforcement sections of two different reinforcement strips are connected together by at least one linking member consisting of a flexible strip fastened to the reinforcement strips above or underneath said reinforcement strips and the reinforcement strips are twisted a half-turn between two linking members.

13. The reinforcement member according to claim 12, wherein the linking members are arranged substantially symmetrically in relation to an axis passing through the middle of the reinforcement strips connected together.

14. The reinforcement member according to claim 13, wherein the reinforcement strips are twisted a half-turn in a first direction and a half-turn in an opposite direction between two linking members.

15. The reinforcement member according to claim 12, wherein the linking members are strips.

16. A method of manufacturing a reinforcement member intended to reinforce a structure comprising a fill, comprising the following successive steps:

arranging at least two reinforcement strips in a substantially parallel manner, connecting the reinforcement strips via a plurality of linking members, consisting of flexible strips fastened to the reinforcement strips above or underneath said reinforcement strips, folding back the reinforcement strips on themselves in such a way as to form a loop between two linking members.

17. The method of manufacturing reinforcement members according to claim 16, wherein the reinforcement strips are twisted a half-turn before arranging at least one linking member on each side of the twisted portion.

18. The method of manufacturing a soil reinforced structure comprising a fill, reinforcement strips comprising reinforcement sections that extend in a reinforced area of the fill located at the rear of a front face of the structure, and a facing placed along said front face, the reinforcement strips being anchored to the facing in respective anchoring regions comprising the following steps:

implementing the method according to claim 16 and/or supplying of reinforcement members according to claim 12, incorporating into the facing of the reinforcement members in such a way as to form at least one path between two protruding points located on a rear face of the facing adjacent to the fill where the at least one path comprises two rectilinear portions respectively adjacent to the two protruding points and each one arranged in the same protruding plane (P) perpendicular to said rear face, two curved portions respectively define an extension of the two rectilinear portions and arranged outside from the protruding plane (P), and a connecting portion connecting together the two curved portions and having at least one loop located outside of the protruding plane.

* * * * *